US005153968A

United States Patent [19]

Sterin et al.

[11] Patent Number: 5,153,968

[45] Date of Patent: Oct. 13, 1992

[54] PROCESS FOR THE TREATMENT OF COTTON

[75] Inventors: Shlomo Sterin; Rivka Yucha; Hilda Guttmann, all of Jerusalem; Herzel Lask, Givataim, all of Israel

[73] Assignee: Israel Fiber Institute, State of Israel, Ministry of Industry and Trade, Jerusalem, Israel

[21] Appl. No.: 611,034

[22] Filed: Nov. 8, 1990

[30] Foreign Application Priority Data

Nov. 14, 1989 [IL] Israel ..... 92299

[51] Int. Cl.[5] ..... D01G 9/00; D01G 37/00

[52] U.S. Cl. ..... 19/66 CC; 19/200; 19/0.27

[58] Field of Search ..... 19/0.27, 66 R, 66 CC, 19/65 CR, 200, 201, 202, 203, 106 R

[56] References Cited

U.S. PATENT DOCUMENTS

| | | | |
|---|---|---|---|
| 2,163,242 | 6/1939 | Kagan . | |
| 2,463,272 | 3/1949 | Hoffman . | |
| 2,979,782 | 4/1961 | Boer . | |
| 3,308,344 | 3/1967 | Smith et al. . | |
| 4,554,708 | 11/1985 | Leifeld et al. | 19/66 CC |
| 4,796,334 | 1/1989 | Yecheskel et al. . | |
| 4,888,856 | 12/1989 | Yescheskel et al. | 19/0.27 |
| 4,896,400 | 1/1990 | Polli | 19/0.27 |
| 4,969,234 | 11/1990 | Waeber et al. | 19/66 CC |
| 4,980,952 | 1/1991 | Erni et al. | 19/106 R |
| 4,989,297 | 2/1991 | Yecheskel et al. | 19/0.27 |
| 4,999,926 | 3/1991 | Knabenhans et al. | 19/66 CC |
| 5,008,978 | 4/1991 | Waeber et al. | 19/66 CC |

*Primary Examiner*—Werner H. Schroeder
*Assistant Examiner*—Michael A. Neas
*Attorney, Agent, or Firm*—Davis Hoxie Faithfull & Hapgood

[57] ABSTRACT

The invention provides a process for reducing the adhesiveness of sticky droplets on the surface of a cotton fiber comprising decoalescing the droplets and dispersing the contents thereof along the surface of the fiber wherein the dispersion is effected by passing the fiber between a pair of rotary rollers, the rollers being pressed against each other and being revolved at different relative speeds.

11 Claims, 1 Drawing Sheet

PROCESS FOR THE TREATMENT OF COTTON

The present invention relates to a process for reducing the adhesiveness of sticky droplets on the surface of cotton fibers.

As is known, insect residue is the cause of the sticky contaminants frequently found on cotton. Such contaminants, generally referred to as "honeydew" can cause serious problems in the processing stages of cotton, especially during carding, drawing and spinning. The stickiness causes fibers to adhere to the rollers of the textile machines; the rollers have to be cleaned, and work stoppages result. As a consequence, there are serious time losses and a great increase in waste and loss of efficiency; production costs increase and the product quality is decreased.

It is an object of the present invention to overcome and eliminate the problems caused by the sticky constituents of raw cotton, such as honeydew droplets that adhere to cotton fibers and are produced, in most cases, by insects.

The droplets consist, in large measure, of sugars and/or polysaccharides dissolved in water in the form of a "gel". They cause serious problems during the various processing stages of the cotton. It has now been discovered that by softening and spreading these droplets on the surface of the cotton fibers, their adhesive properties are eliminated. This spreading may be applied at various processing stage, but it is most effective during the carding process.

Thus according to the present invention there is now provided a process for reducing the adhesiveness of sticky droplets on the surface of a cotton fiber comprising decoalescing said droplets and dispersing the contents thereof along the surface of said fiber wherein said dispersion is effected by passing said fiber between a pair of rotary rollers, said rollers being pressed against each other and being revolved at different relative speeds.

The invention also provides a device for reducing the adhesiveness of sticky droplets on the surface of cotton fibers comprising at least one pair of rotary rollers, said rollers being pressed against each other and being revolved at different relative speeds, means for feeding said fibers between said pair of rollers; and means for decoalescing said droplets, whereby the contents thereof are readily dispersed along the surface of said fibers by the action of said rollers thereon.

In U.S. Pat. No. 4,796,334 there is described and claimed a device for rendering adhesive honydew droplets adhering to cotton fibers non-adhesive, and for rendering them brittle and hard, which comprises at least one heated means with which the cotton fibers are brought into contact so that the fibers are heated to a temperature higher than 70° C. for a period of time of from ½ to 3 seconds, the heated means being formed as a heated plate which is contacted with the upper surface of cotton bales as cotton tufts are plucked from them by a bale opener, said contact preceding the removal of cotton tufts by the bale opener, the surface temperature of the heated plate being adequate to render honeydew droplets or other sticky substances, nonsticky.

In corresponding Israel Patent 74469, upon which said U.S. Patent is based, there is also described and claimed a process for rendering droplets of honeydew or other sticky substances, adhering to cotton fibers, non-adhesive, which comprises subjecting such cotton fibers to heating to a preselected temperature by conduction, i.e. by contact heat treatment for a preselected period of time to render such droplets hard and brittle.

As will be realized, said patents propose a solution which is diametrically opposite to the solution of the present invention in that said patents propose heating the droplets to a sufficient temperature to render them hard and brittle while the present invention is based on the discovery that the sugar droplets in the form of a "gel" have "cold flow" properties which allow them to be softened by different methods and with small expenditures of energy. The droplets may be subjected to pressure, to treatment with various solvents (organic and inorganic) and their solutions in the liquid or vaporous phases or to mild heating to soften and decoalesce said droplets after which the mechanical action of a pair of rollers revolving at different relative speed serves to spread and disperse the content of said droplets along the surface of the fiber passing between said rollers rendering said droplets non-adhesive.

Utilizing these conditions, the softened sugar droplets lose their adhesive properties, but cotton quality is not adversely affected. Furthermore, the spreading process crushes the impurities present in the cotton and cleans the fibers more effectively.

As stated, the spreading is carried out by rotary rollers in which the surface velocity of one of them is more than the surface velocity of the other, and one of the rollers presses against the other, and it has been found that excellent results are achieved when the surface velocity of one of said rollers is about 3% to 25% greater than the surface velocity of the other roller. It has been found, however, that a difference of 3%–12% in the surface velocities of the rollers is sufficient for this purpose, As explained hereinbefore, the droplets can be decoalesced by pressure applied by the rollers and a pressure between the rollers of at least 1N/cm of the length of the roller is preferred.

In fact it is believed that said softening may be effected by any physical treatment which involves heating and/or increasing the molecular movement, such as radiation, ultrasonics, electromagnetic fields of various frequencies, etc.

When softening by heating the temperature of the surface of the rollers needs to be no more than than 70° C. and usually no more than 30° C.–50° C.

Alternatively said droplets can be decoalesced by treatment with various solvents therefore such as water, perchlorethylene or dicloro di floro ethylene or by treatment with solutions with various surfactants in the liquid or vaporous phases, for example: nonionic surfactants, e.g., ethoxylated nonyl phenol, anionic surfactants, e.g., sulfonated alkyl naphtalene, or cationic surfactant, e.g., 1 ethyl 1 ethoxy 2 tallow imidazolium ethyl sulfate, prior to dispersion.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

IN THE DRAWINGS

Figure 1:
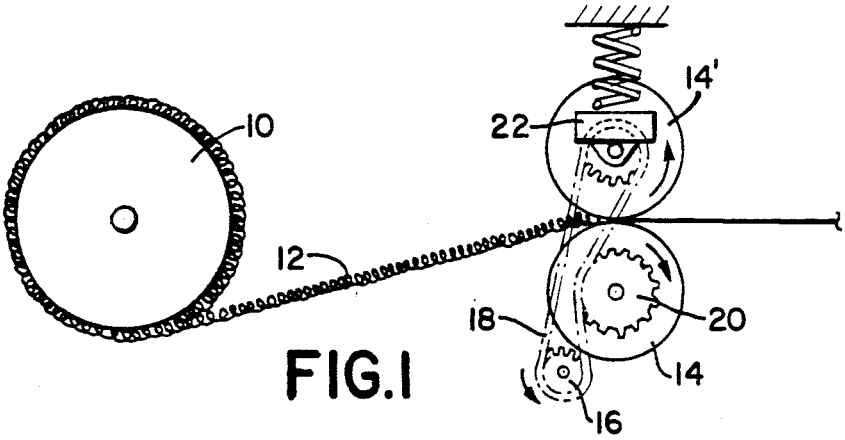
FIG. 1 is a diagrammatic side elevation of the invention, showing a method of driving the crush rollers.

There is seen in FIG. 1 a doffer 10 of a card machine (not shown) from which a cotton web 12 is being unwound. The cotton web 12 is drawn in between a pair of crush rollers, 14, 14' which are driven at a speed differential of 3%-25%. The illustration shows a method of achieving this; a chainwheel 16 drives a drive chain 18 which itself drives a chainwheel 20 attached to a crush roller 14 and a smaller chainwheel attached to the crush roller 14'. The crush roller bearing 22 is acted on by at least one spring 24, the latter being adjusted to produce a force of at least 1N per cm of roller length.

In operation it is found that the spreading of sticky droplets that adhere to the cotton fibers renders them non-adhesive and does not degrade cotton quality (see Example 1). The crushing and spreading action of the crush rollers 14, 14' dilutes any impurities in the cotton web 12 and produces clean fibers effectively.

Figure 2:
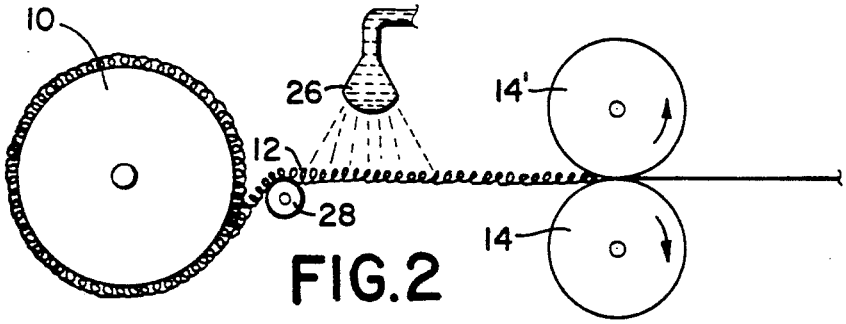
FIG. 2 is a second embodiment of the invention, showing a method of softening the droplets on the cotton fibers.

FIG. 2 shows a second embodiment of the invention. There is seen an additional processing stage to soften the sticky droplets and to increase the effectiveness of the spreading action of the crush rollers 14, 14'. A solvent spray 26 is positioned between the doffer 10 and the crush rollers 14, 14'. Guide roller 28 facilitates the removal of the cotton web 12 from the doffer 10.

Figure 3:
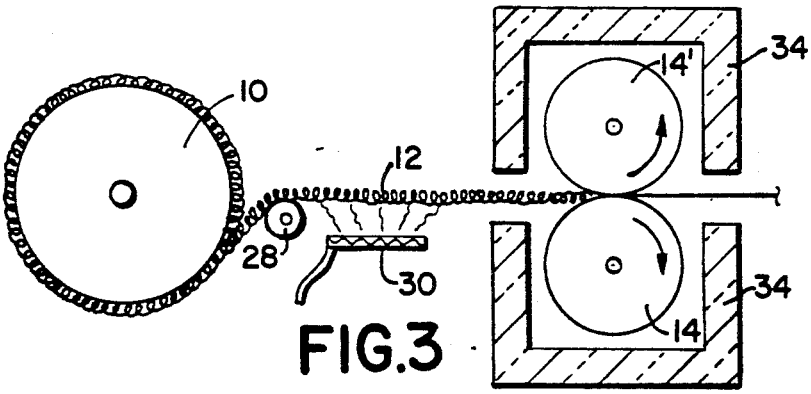
FIG. 3 shows a third embodiment of the invention.

In FIG. 3 there is shown an embodiment where the crush rollers 14, 14' are situated in a heat-insulating enclosure 34 which reduces the loss of warm air and/or reduces the discharge of solvent vapour into the surroundings. A heater 30 creates a heating zone through which the cotton web passes, thereby heating the cotton web 12 and any contaminants found thereon, and thereby facilitating dispersion of adhesive substances by the crush rollers 14, 14'.

Figure 4:
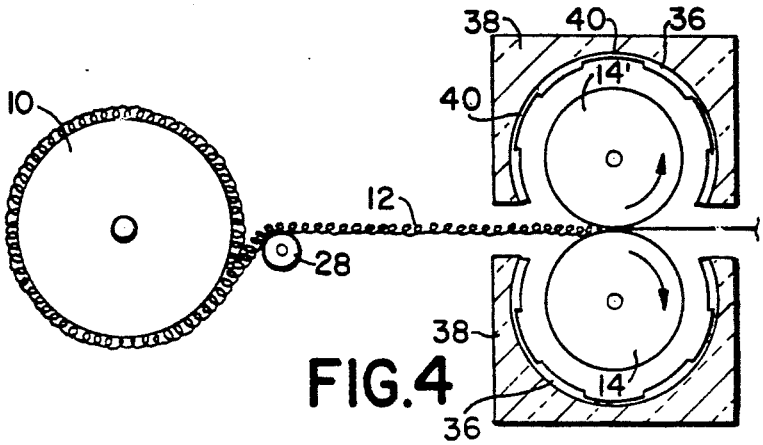
FIG. 4 shows a fourth embodiment of the invention wherein the crush rollers are heated by radiation elements.

FIG. 4 also shows a fourth embodiment and shows a method of heating the crush rollers 14, 14' by the use of thermal heat radiating elements 36 these being attached to a heat-insulating enclosure 38. Thermal reflectors 40 are optionally provided. Obviously, the rollers may be heated by other methods.

For severely contaminated fibers, the sticky droplets may be softened by some combination of the solvent spray 26, the heater 30 and the heat radiating elements 36.

It was found that the method and apparatus of the present invention for treatment of cotton substantially reduces or completely eliminates the stickiness of the fiber.

The invention will now also be described in connection with certain preferred embodiments in the following examples so that aspects thereof may be more fully understood and appreciated, it is not intended to limit the invention to these particular embodiments. On the contrary, it is intended to cover all alternatives, modifications and equivalents as may be included within the scope of the invention as defined by the appended claims. Thus, the following examples which include preferred embodiments will serve to illustrate the practice of this invention, it being understood that the particulars shown are by way of example and for purposes of illustrative discussion of preferred embodiments of the present invention only and are presented in the cause of providing what is believed to be the most useful and readily understood description of formulation procedures as well as of the principles and conceptual aspect of the invention.

EXAMPLE 1

20 g of sticky cotton were processed on the minicard "Platt" in the usual way to test the tendency to stickiness. There were 24 points of stickiness on the web drum and on the pressure roller.

However, when processing this sticky cotton on the same minicard, after spreading it between the pressure roller and the web drum by changing the surface velocity of the rollers to about 6% and the pressure between the rollers to about 2N/cm of the length, there were only 5 points of stickiness.

EXAMPLE 2

20 g of very sticky cotton were processed on the minicard "Platt" in the usual way to test the tendency to stickiness. There were 44 points of stickiness on the web drum and on the pressure roller.

The same sticky cotton was processed on the minicard using the presently claimed device; spreading between the pressure roller and the web drum was 6%, the pressure between the rollers was about 2N/cm of the length and the temperature of the drum was 60° C. and the temperature of the pressure roller was 30° C., there were only 3 points of stickiness.

The same cotton was processed the second time on the usual card, without using the present device, to test the tendency to stickiness after the presently claimed treatment. There were no sticky points at all; therefore, cotton stickiness was eliminated.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A process for reducing the adhesiveness of sticky droplets on the surface of a cotton fiber comprising decoalescing said droplets and dispersing the contents thereof along the surface of said fiber wherein said dispersion is effected by passing said fiber between a pair of rotary rollers, said rollers being pressed against each other and being revolved at different relative speeds.

2. A process according to claim 1 wherein in said pair of rollers the surface velocity of one of said rollers is about 3 to 25% greater than the surface velocity of the other roller.

3. A process according to claim 1 wherein in said pair of rollers the surface velocity of one of said rollers is about 3 to 12% greater than the surface velocity of the other roller.

4. A process according to claim 1 wherein a plurality of cotton fibers are simultaneously processed.

5. A process according to claim 4 wherein said cotton fibers are in a layer form.

6. A process according to claim 4 wherein said cotton fibers are in a web form.

7. A process according to claim 1 wherein said droplets are decoalesced by pressure applied by said rollers.

8. A process according to claim 7 where the pressure between the rollers is at least 1N/cm of the length of the roller.

9. A process according to claim 1 wherein said droplets are decoalesced by treatment with solvent prior to dispersion.

10. A process according to claim l wherein said droplets are decoalesced by heating the surface of the rollers to a temperature of about 30°-70° C. to effect the softening of said droplets.

11. A process according to claim 1 wherein said droplets are decoalesced by passing said fiber through a heated zone to effect the softening of said droplets prior to dispersion.

* * * * *